US007513585B2

(12) United States Patent
Nishida

(10) Patent No.: US 7,513,585 B2
(45) Date of Patent: Apr. 7, 2009

(54) PRINTHEAD, PRINTHEAD CARTRIDGE, PRINTING APPARATUS, AND ELEMENT SUBSTRATE OF PRINTHEAD

(75) Inventor: Hideyuki Nishida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 262 days.

(21) Appl. No.: 11/393,914

(22) Filed: Mar. 31, 2006

(65) Prior Publication Data

US 2007/0236520 A1 Oct. 11, 2007

(30) Foreign Application Priority Data

Apr. 4, 2005 (JP) ..... 2005-107750

(51) Int. Cl.
*B41J 29/38* (2006.01)

(52) U.S. Cl. ..... 347/9

(58) Field of Classification Search ..... None
See application file for complete search history.

(56) References Cited

U.S. PATENT DOCUMENTS

| | | | | |
|---|---|---|---|---|
| 6,439,678 | B1 * | 8/2002 | Norton | 347/9 |
| 6,439,680 | B1 | 8/2002 | Mochizuki et al. | |
| 2002/0171696 | A1 | 11/2002 | Mochizuki et al. | |
| 2005/0057589 | A1 | 3/2005 | Mochizuki et al. | |

FOREIGN PATENT DOCUMENTS

| | | | |
|---|---|---|---|
| JP | 10-250133 | | 9/1998 |
| JP | 10250133 A | * | 9/1998 |
| JP | 2001-58412 | | 3/2001 |
| JP | 2001-162801 | | 6/2001 |

OTHER PUBLICATIONS

Machine translation of the Detailed Description of JP 10-250133 A.*
Derwent abstract of JP 10-250133 A.*
*Note: Counterpart U.S. patent document(s) also cited (see text of IDS).

* cited by examiner

*Primary Examiner*—Luu Matthew
*Assistant Examiner*—Justin Seo
(74) *Attorney, Agent, or Firm*—Fitzpatrick, Cella, Harper & Scinto

(57) ABSTRACT

A voltage supplied to each printing element can be stabilized even when a number of concurrently driven printing elements varies. A printhead with a plurality of printing elements includes a driving circuit for applying a predetermined voltage to each printing element according to a pulse signal defining a drive of a printing element inputted to the printhead. More specifically, the driving circuit is provided with a set voltage generation section for generating the predetermined voltage according to a setting signal inputted to the printhead. The section receives as the setting signal information on the number of concurrently driven printing elements, and the predetermined voltage applied to each printing element is set so as to have a constant value even when the number of concurrently driven printing elements varies.

10 Claims, 9 Drawing Sheets

PRINTHEAD, PRINTHEAD CARTRIDGE, PRINTING APPARATUS, AND ELEMENT SUBSTRATE OF PRINTHEAD

FIELD OF THE INVENTION

This invention relates to a printhead, a printhead cartridge, a printing apparatus, and an element substrate of printhead. More particularly, this invention relates to the voltage control of a driving circuit for supplying electric energy to each printing element of the printhead.

BACKGROUND OF THE INVENTION

In recent years, along with the spread of personal computers, there are an increasing number of occasions when documents are easily created at home or images are captured with a digital camera or the like.

As a printer used to print these documents or images, inkjet printers are widely spreading, having advantages in low running cost, easy color printing, low operation noise, the capability of printing high-resolution images, and the like.

Particularly, with the resolution of digital cameras increased, the amount (size) of ink droplet discharged has recently become increasingly smaller to enable high-resolution and high-picture quality printing of so-called photo quality. For example, the amount of the ink droplet is as small as 2 pl or less.

When printing high picture quality images with droplets of such small size, to print images of photo quality, it becomes more indispensable than ever before to eliminate a variation in droplet size discharged and stabilize the discharged droplet amount.

For example, with respect to a printhead, manufactured by a semiconductor manufacturing process, for discharging ink using thermal energy generated by an electrothermal transducer such as a heater (heat element), variations in droplet size are mainly divided into three types according to the factors.

Firstly there is a variation ascribable to the manufacturing process of a printhead. Variations within the same substrate, within the same lot and between lots are included in this type. Specifically, the following and other variations are known:

- Variation in heater resistance value;
- Variation in ON voltage of a switching element controlling the supplying of power to a heater; and
- Variation in thickness of a heater protective film.

Secondly there is a variation ascribable to temperature variation. Specifically, the following and other variations are known:

- Variation of ink viscosity;
- Variation of heater resistance value; and
- Variation of ON voltage of a switching element controlling the supplying of power to a heater.

Thirdly there is a variation ascribable to the number of concurrently driven printing elements (nozzle or heater) according to printing images. Specifically, the following and other variations are known:

- Variation due to voltage drop corresponding to the resistance of common wiring.

To eliminate variations in droplet size, several methods have hitherto been proposed for coping with each factor of the above variations in droplet.

With respect to the variation ascribable to manufacturing process (the first factor), printing is actually performed while varying the voltage applied to the printhead, and the blurs of printed characters and images are observed to memorize a voltage at which the blurs do not appear. Then when actually used, the printhead is driven with the memorized voltage to thereby ensure that the influence is eliminated.

With respect to the variation ascribable to temperature variation (the second factor), means for detecting a temperature is arranged within the printhead, and according to the detected temperature, driving voltage and driving pulse time are adjusted so as to adjust energy generated by the heater, whereby it is ensured that the influence is eliminated.

With respect to the variation ascribable to the number of concurrently driven printing elements (the third factor), the following three kinds of approaches are known.

According to a first approach, as described in Japanese Patent Publication Laid-Open No. 10-250133, a variable resistance element is inserted between a printhead and a power source unit supplying energy to the printhead, and the resistance value of the variable resistance element is varied according to the number of concurrently driven heaters to thereby stabilize the discharged droplet amount.

FIG. 7 is a view showing a conventional circuit according to the first approach. Shown in the right side of FIG. 7 (portion a in the right side relative to the broken line) is the internal circuit of a printhead, and a portion denoted by reference numeral 71 is a circuit functioning as the variable resistance.

According to a second approach, as described in Japanese Patent Publication Laid-Open No. 2001-58412, a predetermined voltage generation circuit using a series regulator is provided instead of the variable resistance element in the first approach to supply to the heater a voltage according to a control signal.

FIGS. 8A and 8B are views showing a conventional circuit according to the second approach. FIG. 8A shows the internal circuit of a printhead. FIG. 8B shows a configuration of a predetermined voltage generation circuit 81.

According to a third approach, as described in Japanese Patent Publication Laid-Open No. 2001-162801, an error amplifier is operated so that the voltage applied to a heater is equal to a reference voltage, and the driving voltage is controlled so that a switch for driving the heater is changed to the unsaturated operation, whereby a discharged droplet amount is stabilized.

FIG. 9 is a view showing a configuration of a conventional voltage control circuit according to the third approach. Referring to FIG. 9, reference numerals 91 and 92 denote error amplifiers which receive a reference voltage ($V_{REF}$). Reference numerals 93 and 94 denote a switch and a power transistor, respectively.

As described above, in order to suppress a variation ascribable to the number of concurrently driven printing elements, it is essential to stabilize the voltage applied to the printing element (heater: resistor).

Particularly, in the thermal inkjet technique, stabilizing electric energy applied to the heater has been increasingly desired. According to this technique, a heater, such as a resistor, is used as the printing element, and a pulse signal is supplied to the heater, whereby thermal energy is generated, allowing rapid film boiling to occur on the surface of the heater disposed within a nozzle having filled therein ink. Then the ink within the nozzle is discharged by bubbles generated by thermal energy associated with the boiling.

However, the above-described conventional approaches for eliminating a variation in ink droplet size ascribable to the number of concurrently driven heaters have the following defects.

According to the first approach, as the nozzle density, the number of nozzles, and the printing speed are increased, the current supplied to the printhead becomes larger. In this case, the current value flowing through the variable resistance element can amount to as large as several A (ampere), thus increasing joule loss in the variable resistance element.

Similarly, in a series regulator according to the second approach, also, joule loss increases because energy is collectively supplied to many printing elements. Also, since a feedback control is used, ringing phenomena may occur in response to a sharp voltage variance due to transient response property, thus lacking stability.

According to the third approach, the same number of error amplifiers as the heaters are required. Thus, as the number of printing elements increases, the scale of circuit becomes larger.

In the above description, an inkjet printhead using a heater as the printing element is taken as an example. However, the problem ascribable to a variation in the number of concurrently driven printing elements is common to printheads according to another printing method, as long as printing is performed using a printhead having a plurality of printing elements.

SUMMARY OF THE INVENTION

Accordingly, the present invention is conceived as a response to the above-described disadvantages of the conventional art.

For example, a printhead according to the present invention is capable of stabilizing a voltage supplied to each printing element even when the number of concurrently driven printing elements varies.

According to one aspect of the present invention, preferably, there is provided a printhead with a plurality of printing elements comprising: a driving circuit for applying a predetermined voltage to each printing element according to a pulse signal, for driving a printing element, inputted to the printhead, wherein the driving circuit includes set voltage generation means for generating the predetermined voltage according to a setting signal inputted to the printhead.

More specifically, the printhead according to the present invention with a plurality of printing elements comprises a driving circuit for applying a predetermined voltage to each of the printing elements according to a pulse signal defining a drive of a printing element inputted to the printhead, wherein the driving circuit is provided with set voltage generation means for generating a predetermined voltage according to a setting signal supplied to the printhead.

In accordance with the present invention as described above, if the information on the number of concurrently driven printing elements is inputted as a setting signal, a predetermined voltage applied to each printing element can be set to a constant value even when the number of concurrently driven printing elements varies.

Consequently, a variation in the printing state ascribable to the number of concurrently driven printing elements can be eliminated, thus making it possible to improve printing image quality.

Desirably, the driving circuit includes a low-level prioritization circuit for receiving the predetermined voltage and a first voltage generated when a switching element of which conduction state is controlled by a pulse signal is turned on, and then for outputting lower one. In this case, a setting is preferably made so that the first voltage is higher than the predetermined voltage.

The setting signal is preferably a digital signal of a plurality of bits representing the information on the number of concurrently driven printing elements. Desirably, the set voltage generation means includes a D/A converter for converting the digital signal to an analog signal.

Desirably, the printing element, the driving circuit, and the set voltage generation means are formed on a common element substrate by a semiconductor manufacturing process.

In such construction, wiring is preferably made in the element substrate so that a reference voltage of the set voltage generation means is substantially equal to a reference voltage of the printing element.

In a construction in which the plurality of printing elements are divided into a plurality of blocks, each having a predetermined number of printing elements, wiring is preferably made in the element substrate such that a reference voltage of each printing element is branched out from a common point, and resistances of wirings extending from the common point to each printing element within each block are equal to each other.

Also, wiring is preferably made in the element substrate such that the wiring resistances of power wirings extending to each block are equal to each other.

When a construction is employed in which the predetermined voltage is supplied from the set voltage generation means to each block, the reference voltage of the set voltage generation means is preferably branched from a reference point of the power wiring, and applied.

The printhead according to the present invention is preferably a so-called thermal inkjet printhead in which each printing element includes an electrothermal transducer, and discharges ink by use of thermal energy generated by the electrothermal transducer to perform printing.

According to another aspect of the present invention, preferably, there is provided a printhead cartridge including a printhead having the above construction and an ink tank containing ink to be supplied to the printhead.

According to still another aspect of the present invention, preferably, there is provided a printing apparatus for perform printing using a printhead having the above construction.

According to still another aspect of the present invention, preferably, there is provided a substrate used for a printhead having the above construction.

The invention is particularly advantageous since, by receiving as a setting signal information on a number of concurrently driven printing elements, a predetermined voltage applied to each printing element can be set so as to have a constant value even when the number of concurrently driven printing elements varies.

Consequently, a variation in printing state ascribable to the number of concurrently driven printing elements can be eliminated, thus making it possible to improve the printing image quality.

Also, it is possible to vary the voltage applied to each printing element in a shorter period of time. Accordingly, the driving time period can be shortened by a driving pulse time period extended according to a PWM control, thereby making it possible to perform printing at a higher speed.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

Constituent components described in the following embodiments are merely illustrative, and are not be construed to limit the scope of the present invention.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "printing element (sometimes referred to as "nozzle")" generally means a set of a discharge orifice, a liquid channel connected to the orifice and an element to generate energy utilized for ink discharge.

It is to be understood that, in this specification, printing element is electrically equivalent to an energy generation element (heater) and the mechanical construction thereof includes a discharging orifice and a liquid channel.

Firstly an inkjet printing apparatus for performing printing by means of a printhead according to the present invention will be described with reference to FIGS. 1 and 2.

<Description of Inkjet Printing Apparatus>

Figure 1:
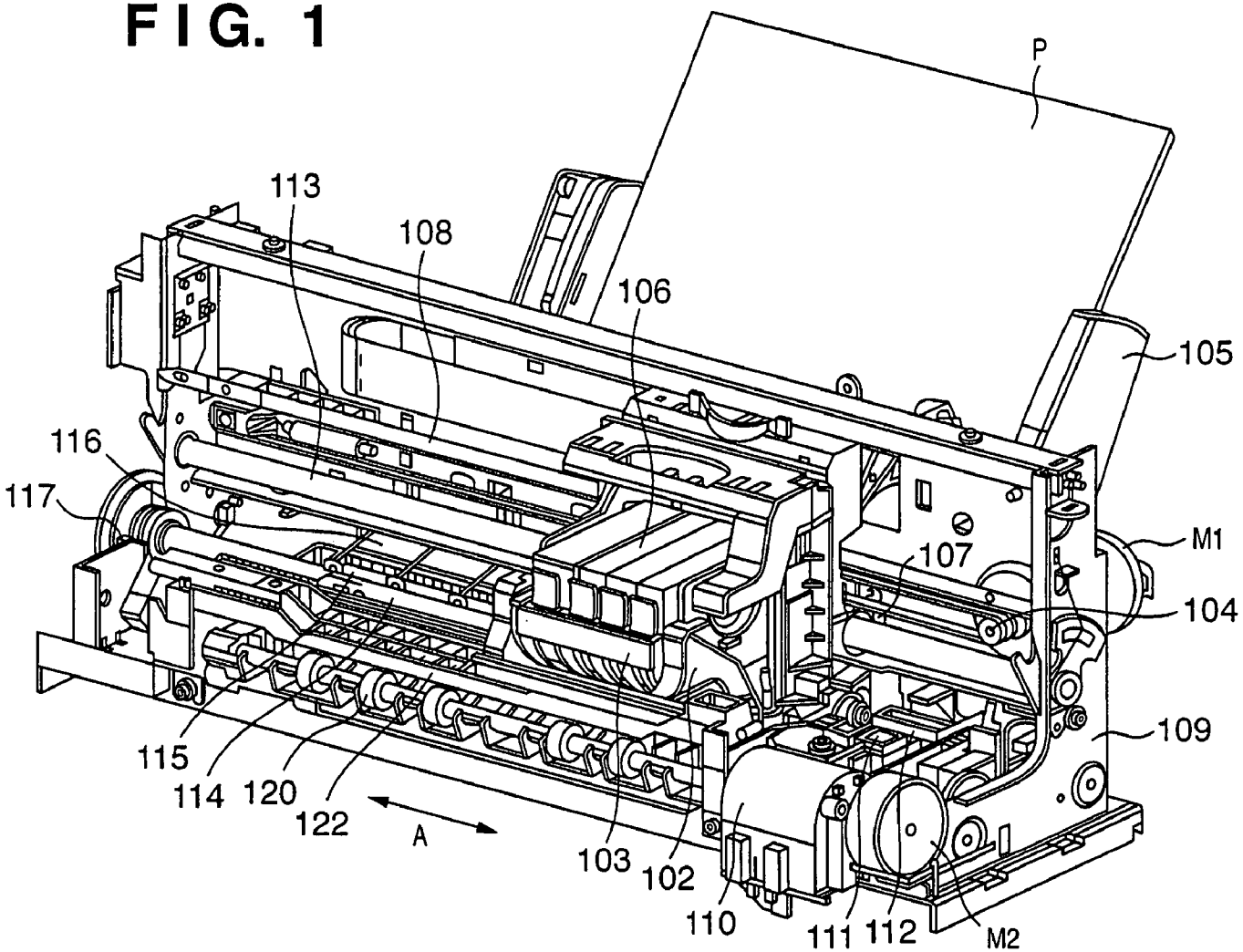
FIG. 1 is an external perspective view showing a schematic construction of an inkjet printing apparatus according to a typical embodiment of the present invention.

FIG. 1 is an external perspective view showing a schematic construction of an inkjet printing apparatus for performing printing by using a printhead according to a typical embodiment of the present invention.

As shown in FIG. 1, the inkjet printing apparatus (hereinafter referred to as a printing apparatus) has mounted on a carriage 102 thereof a printhead 103 for discharging ink based on an inkjet method to perform printing. A driving force generated by a carriage motor M1 is transmitted via a transmission mechanism 104 to allow the carriage 102 to move back and forth in a direction of arrow A. In parallel with this, a printing medium P, such as a printing paper, is fed via a feeding mechanism 105 and conveyed to a printing position. At the printing position, ink is discharged from the printhead 103 to the printing medium P, whereby printing is performed.

Also, to satisfactorily maintain the condition of the printhead 103, the carriage 102 is moved to the position of a recovery device 110 to intermittently perform a recovery processing of the printhead 103.

On the carriage 102 of the printing apparatus, there is mounted not only the printhead 103 but also an ink cartridge 106 having stored therein ink to be supplied to the printhead 103. The ink carriage 106 is attachable/detachable to the carriage 102.

The printing apparatus shown in FIG. 1 can perform color printing. Accordingly, on the carriage 102, there are mounted four ink cartridges containing magenta (M), cyan (C), yellow (Y) and black (K) ink, respectively. These four ink cartridges are attachable/detachable independently from each other.

As for the carriage 102 and the printhead 103, the joint surfaces of the two members are properly in contact with each other to make it possible to achieve and maintain a required electric connection therebetween. When energy is applied to the printhead 103 in response to a printing signal, the printhead 103 selectively discharges ink from a plurality of discharging orifices (nozzles) to perform printing. Particularly, in the printhead 103 according to the present embodiment, an inkjet method for discharging ink by use of thermal energy is employed. Thus the printhead 103 includes an electrothermal transducer (heater) for generating thermal energy, and electric energy applied to the electrothermal transducer is converted into thermal energy. When the thermal energy is supplied to ink, film boiling occurs in the ink, and pressure change caused by the growth and shrinkage of the resultant bubbles is used to cause the ink to be discharged from the discharging orifice. The electrothermal transducer is provided for each discharging orifice, and when a pulse voltage is applied to a corresponding electrothermal transducer in response to a printing signal, ink is discharged from the corresponding discharging orifice.

As shown in FIG. 1, the carriage 102 is joined to part of a driving belt 107 of the transmission mechanism 104 for transmitting the driving force of the carriage motor M1, and slidably guided and supported in a direction of arrow A along a guide shaft 113. Accordingly, the carriage 102 moves back and forth along the guide shaft 113 according to the normal/reverse rotation of the carriage motor M1. Also, along the movement direction (direction of arrow A) of the carriage 102, there is provided a scale 108 for indicating the absolute position of the carriage 102. The scale 108 used in the present embodiment is obtained by printing black bars at a required pitch on a transparent PET film. One end of the scale is fixed to a chassis 109, and the other end is supported by a plate spring (not shown).

Also, in the printing apparatus, a platen (not shown) is provided to face the discharging orifice surface on which the discharging orifice (not shown) of the printhead 103 is formed. The carriage 102 having mounted thereon the printhead 103 is moves back and forth according to the driving force of the carriage motor M1, and at the same time a printing signal is supplied to the printhead 103 to discharge ink. Accordingly, printing is performed across the entire width of the printing medium P conveyed onto the platen.

Further, referring to FIG. 1, reference numeral 114 denotes a conveyance roller driven by the conveyance motor M2 to convey the printing medium P, and 115 denotes a pinch roller in which a spring (not shown) allows the printing medium P to abut against the conveyance roller 114. Reference numeral 116 denotes a pinch roller holder for rotatably supporting the pinch roller 115, and 117 denotes a conveyance roller gear fixed to one end of the conveyance roller 114. The conveyance roller 114 is driven by the rotation of the conveyance motor M2 transmitted to the conveyance roller gear 117 via an intermediate gear (not shown).

Further, reference numeral 120 denotes a discharge roller for discharging to the outside of the printing apparatus the printing medium P having an image formed thereon by the printhead 103. The discharge roller 120 is driven by the rotation of the conveyance motor M2 transmitted. The discharge roller 120 is contacted by a spur roller (not shown) for pressing the printing medium P by means of a spring (not shown). Reference number 122 denotes a spur holder for rotatably supporting the spur roller.

Further, in the printing apparatus, as shown in FIG. 1, the recovery device 110 for allowing the printhead 103 to recover from a discharge failure is disposed at a desired position (for example, a position corresponding to the home position) outside the range (the printing range) in which the carriage 102 having mounted thereon the printhead 103 moves back and forth to perform printing.

The recovery device 110 includes a capping mechanism 111 for capping the surface of discharging orifice of the printhead 103 and a wiping mechanism 112 for cleaning the surface of discharging orifice of the printhead 103.

<Control Configuration of Inkjet Printing Apparatus>

Figure 2:
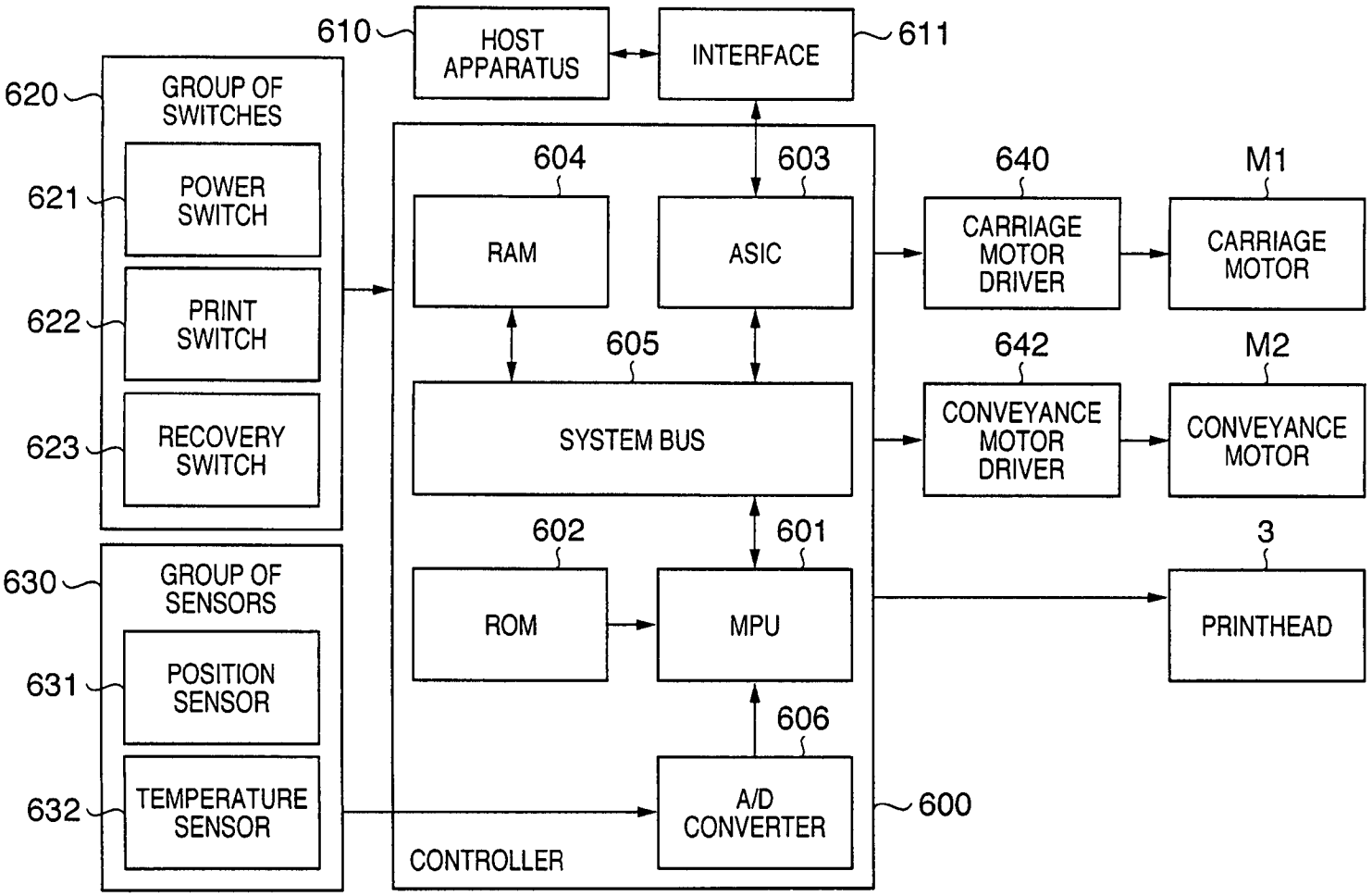
FIG. 2 is a block diagram showing a configuration of a control circuit of the printing apparatus of FIG. 1.

FIG. 2 is a block diagram showing a control configuration of the printing apparatus shown in FIG. 1.

As shown in FIG. 2, a controller 600 includes an MPU 601, a ROM 602, an application specific integrated circuit (ASIC) 603 and a RAM 604. In the ROM 602, there are stored a program corresponding to a control sequence to be described later, a required table, and other fixed data. The ASIC 603 generates control signals for controlling the carriage motor M1, the conveyance motor M2 and the printhead 103. In the RAM 604, there are provided an image data bitmapping area, a working area for executing programs, and the like. The MPU 601, ASIC 603 and RAM 604 are connected to each other via a system bus 605 to receive and send data. Also, the controller 600 further includes an A/D converter 606 for receiving an analog signal from a group of sensors described below, performing A/D conversion, and supplying the converted digital signal to the MPU 601.

Also, referring to FIG. 2, reference numeral 601 denotes a computer (or a reader for reading images, a digital camera or the like) acting as an image data supplying source, collectively called a host apparatus. Image data, commands, status signals and the like are transmitted/received between the host apparatus 610 and the printing apparatus 1 via an interface (I/F) 611.

Further, a group of switches 620 includes switches for receiving instructions from an operator, such as a power switch 621, a print switch 622 for supplying a print start instruction, and a recovery switch 623 for supplying an instruction for initiating the processing (recovery processing) for satisfactorily maintaining the ink discharge performance of the printhead 103. The group of sensors 630 for detecting the apparatus condition is composed of a position sensor 631, such as a photo coupler for detecting the home position, a temperature sensor 632 disposed at an appropriate position of the printing apparatus to detect the environment temperature, and the like.

Further, reference numeral 640 denotes a carriage motor driver used to drive the carriage motor M1 for allowing the carriage 2 to perform back-and-forth scanning in a direction of arrow A, and 642 denotes a conveyance motor driver used to drive the conveyance motor M2 for conveying a printing medium P.

When printing and scanning are performed by the printhead 103, while directly accessing the storage area of the RAM 602, the ASIC 603 transfers in a serial manner to the printhead, data (DATA) for selecting, according to image data to be printed, a printing element (heater) to be driven, in synchronization of a clock signal. In addition, the ASIC 603 further supplies a pulse signal (driving pulse) determining driving timing.

Signals supplied from the main body of printing apparatus to the printhead include: a voltage for driving logic circuits; a voltage for driving a heater; data signals corresponding to image data; a clock signal for determining a data transfer timing; a signal for specifying a block to be driven, a driving pulse signal for determining a heater driving timing; and a correction signal (described later) of n bits corresponding to the number of concurrently driven heaters.

First Embodiment

Figure 3:
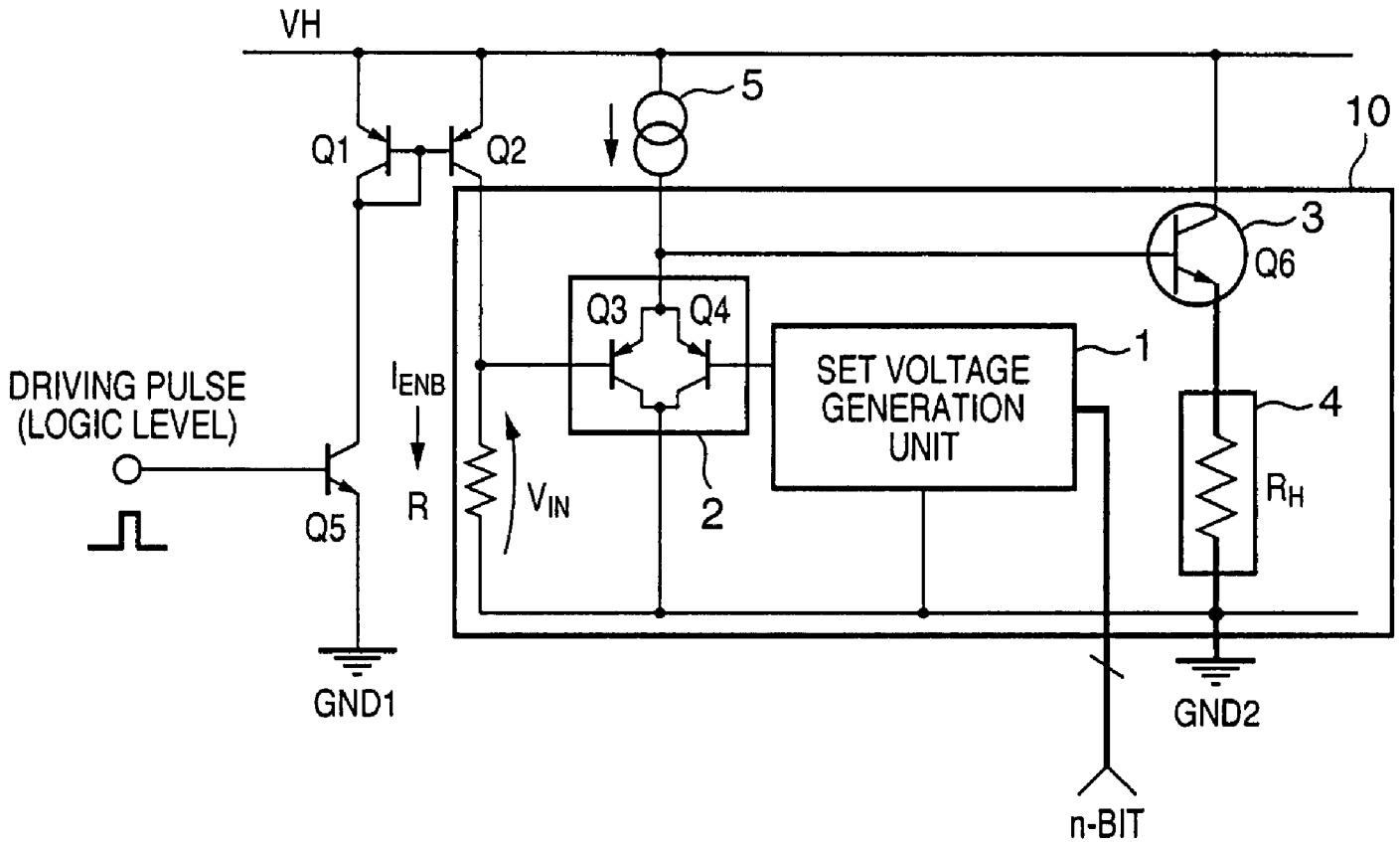
FIG. 3 is a block diagram showing a configuration of a driving circuit of a printhead according to a first embodiment of the present invention.

FIG. 3 is a block diagram showing a configuration of a printhead driving circuit used in the aforementioned printing apparatus. It is noted that this drawing is simplified one except portions required for explaining the present invention. For example, wiring etc. of the logic circuit are omitted so as to avoid complexity of the drawing.

Referring to FIG. 3, reference numeral 4 denotes a heater (resistor) $R_H$ being a printing element, 3 denotes an NPN transistor (Q6) for driving the heater, 1 denotes a set voltage (Vset) generation unit, and 2 denotes a low-level prioritization circuit comprised of a PNP transistor Q3 and a PNP transistor Q4.

Reference numeral 10 denotes a printing element driving circuit comprised of the set voltage generation unit 1, a resistor R, the low-level prioritization circuit 2, the NPN transistor 3 and the printing element 4. Hereinafter, the printing element driving circuit 10 is also referred to as a basic cell for the convenience of the explanation.

Reference numeral 5 denotes a constant current source for supplying to the low-level prioritization circuit 2 and the NPN transistor 3, a current required for operation.

The operation of the printhead driving circuit will be described with reference to FIG. 3.

Firstly image data corresponding to the number of printing elements is sent from the main body of printing apparatus (ASIC 603) in a serial manner in synchronization with a clock signal, and stored into a shift register (not shown) and latched. Thereafter, a driving pulse for determining a drive timing of a printing element is received. This signal is received at a logic level of, for example, 3.3 V and inputted to the base of an NPN transistor Q5.

The operation (1) where the NPN transistor Q5 is turned on at the time when the driving pulse is at a high level, and the operation (2) where the NPN transistor Q5 is turned off at the time when the driving pulse is at a low level will be described below.

(1) Operation where the NPN Transistor Q5 is turned on

When the driving pulse is changed to a high level, the NPN transistor Q5 is turned on, and a current flows. This current causes current $I_{ENB}$ to flow through a resistor R connected between the base of the PNP transistor Q3 and GND 2 by means of a current mirror circuit composed of: a PNP transistor Q1 of which the collector and base are shorted to form diode connection; and a PNP transistor Q2 of which the base is connected to the base of the PNP transistor Q1.

When current $I_{ENB}$ flows through the resistor R, voltage $V_{IN}$ is generated between both ends of the resistor R. Voltage $V_{IN}$ is generated when the driving pulse inputted to the base of the NPN transistor Q5 is at a high level, and the value thereof is set higher than Vset generated by the set voltage generation unit 1. More specifically, a design is made in advance such that current $I_{ENB}$ flows satisfying $Vset<V_{IN}$.

At this time, as for the PNP transistor Q3 and PNP transistor Q4 constituting the low-level prioritization circuit 2, the emitter and collector, respectively, are mutually connected, and $Vset<V_{IN}$ as described above. Thus, the PNP transistor Q3 is turned off, while the PNP transistor Q4 is turned on.

At this time, the PNP transistor Q4 and the constant current source 5 constitutes a so-called emitter follower circuit, and the emitter follower circuit drives the base of the NPN transistor 3 (Q6) at a voltage value obtained by adding a base-emitter voltage ($V_{BE}$) of the PNP transistor Q4 to a voltage (Vset) set in the set voltage generation unit 1.

The NPN transistor 3 (Q6) is also an emitter follower circuit, and thus, this time, a voltage value obtained by subtracting the base-emitter voltage ($V_{BE}$) is outputted. Consequently, applied to the printing element ($R_H$) 4 is the voltage value (Vset) set in the set voltage generation unit 1.

(2) Operation where the NPN Transistor Q5 is turned off

When the driving pulse is changed to a low level, the NPN transistor Q5 is turned off, and no current flows. Accordingly, no current flows in the current mirror circuit composed of the PNP transistors Q1 and Q2. Thus, current $I_{ENB}$ does not flow through the resistor R, and no voltage is generated between both ends thereof.

Consequently, the base voltage of the PNP transistor Q3 is changed to GND voltage. In other words, $V_{IN}=0$.

In this case, as for the PNP transistor Q3 and PNP transistor Q4 constituting the low-level prioritization circuit 2, $Vset>0$. Thus, the PNP transistor Q3 is turned on, while the PNP transistor Q4 is turned off.

At this time, a current from the constant current source 5 flows into the PNP transistor Q3, and the collector-emitter voltage of the PNP transistor Q3 becomes approximately equal to $V_{BE}$, driving the base of the NPN transistor 3 (Q6). However, most of the current flows through the PNP transistor Q3, and only a small current flows to the base of the NPN transistor 3 (Q6). In addition, since the NPN transistor 3 (Q6) is also an emitter follower circuit, a voltage value obtained by subtracting the base-emitter voltage $V_{BE}$ is outputted to the printing element ($R_H$) 4. Consequently, the voltage applied to the printing element ($R_H$) 4 is 0 volt, i.e., no current flows.

As described above, according to the present embodiment, by virtue of provision of the low-level prioritization circuit 2, the driving pulse supplied to the NPN transistor Q5 only determines a driving time (timing and period of time), and the voltage value for driving the printing element 4 becomes equal to the set voltage (Vset) generated by the set voltage generation unit 1. Consequently, the energy driving the printing element 4 can be controlled by the set voltage (Vset) and a period of time when the driving pulse is at ON state.

Figure 4:
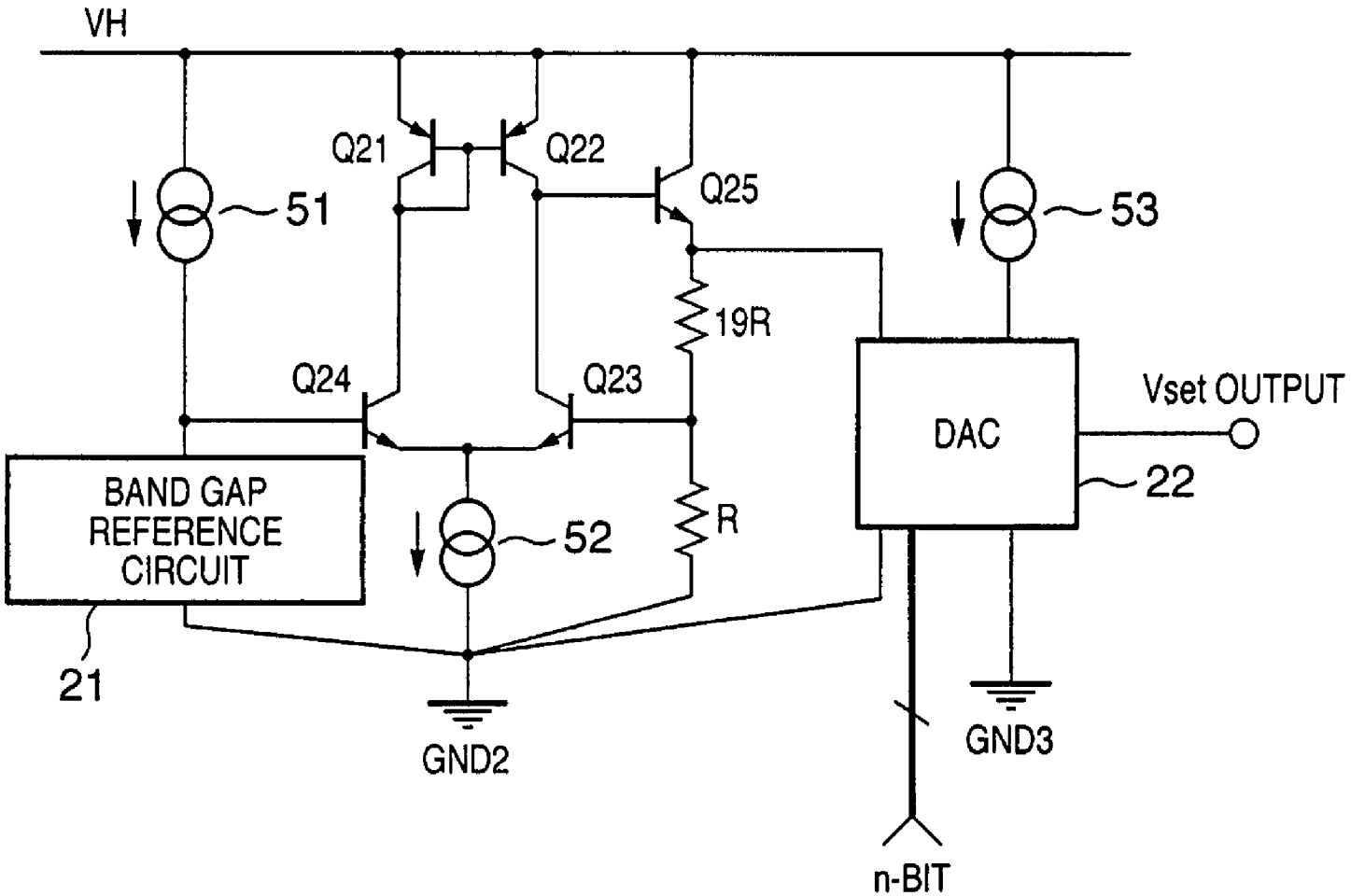
FIG. 4 is a circuit diagram showing an exemplary configuration of a set voltage generation unit 1 according to the first embodiment.

FIG. 4 is a circuit diagram showing an exemplary configuration of the set voltage generation unit 1.

Referring to FIG. 4, reference numeral 21 denotes a bandgap reference circuit, 22 denotes a digital/analog converter (hereinafter referred to as a DAC). As for the contents of these circuits, well-known techniques can be used, and hence detailed descriptions thereof are omitted.

A constant current source 51, a constant current source 52 and a constant current source 53 operate as a bias power source for supplying a current required for circuit operation to the bandgap reference circuit 21, a differential amplifier composed of transistors 021, Q22, Q23 and Q24, and the DAC 22, respectively.

Actually, the constant current sources 51 and 53 are each composed of a current mirror circuit constructed with a bias circuit (not shown) of a PNP transistor. The constant current source 52 is composed of a current mirror circuit constructed with a bias circuit (not shown) of an NPN transistor.

The operation of the set voltage generation unit 1 will now be described.

The bandgap reference circuit 21 generates a temperature-coefficient-fully compensated reference voltage, for example, 1.25 V. The voltage of 1.25 V is applied to the base of the transistor Q24 being a non-inverted input of the differential amplifier composed of the transistors Q21, Q22, Q23 and Q24.

At this time, in the set voltage generation unit 1, as shown in FIG. 4, a negative feedback is applied to the base of the transistor Q23 being an inverted input of the differential amplifier from the emitter of the transistor Q25 being an output stage of the differential amplifier via a voltage dividing point between resistors 19R and R. Here, reference characters 19R and R in the resistors 19R and R indicate a ratio of resistance value between these two resistors, and the resister 19R is set to nineteen times the value of the resistor R.

When the circuit is configured in this manner, due to imaginary-short property of the differential amplifier, a negative feedback works so as to equalize the base voltage of the transistor Q24 with that of the transistor Q23. Thus, as an output voltage from the emitter of the NPN transistor Q25, a voltage of twenty times a value of 1.25 V being an output voltage of the bandgap reference circuit 21 is generated; in this example, a voltage of 25 V is generated.

Accordingly, in such configuration, if the value of the resistor 19R is set according to a desired voltage, any given reference voltage can be supplied to the DAC 22.

This temperature-compensated reference voltage is supplied to the DAC 22. Meanwhile, the DAC 22 receives from the control unit (ASIC 603) of the main body of printing apparatus, digital data of n bits representing a correction voltage corresponding to the number of concurrently driven heaters. The DAC 22 updates based on this n-bit data, a set voltage Vset at order of several tens of n sec being a conversion rate of the DAC 22.

More specifically, based on a correction voltage represented by n-bit digital data sent from the main body of printing apparatus according to the number of concurrently driven printing elements 4 which varies momentarily (generally, at order of approximately 1 to 2 μs) depending on printing images, the reference voltage supplied to the DAC can be varied at a step of $2^n$. Accordingly, it is possible to apply a stable voltage corrected to the printing element 4 at all times.

In the present embodiment described above, by use of the electrical circuit having the configuration shown in FIGS. 3 and 4, it is possible to correct a voltage drop corresponding to the common wiring resistance ascribable to the number of concurrently driven printing elements (hereinafter referred to as "concurrently driven number") which varies momentarily (generally, at order of approximately 1 to 2 μs) depending on printing images.

Given above with reference to FIGS. 3 and 4 is a description of the configuration capable of stably applying a voltage to the printing element 4 at a high rate (similar to the conversion rate of the DAC) according to digital data representing a correction voltage value sent from the main body of printing apparatus.

A specific configuration for applying the above configuration to an actual printhead to supply a substantially stable voltage to the printing element 4 will now be described.

To supply a substantially stable voltage to the printing element 4, determination of a reference voltage of wiring resistance and each block within an element substrate (chip) of a semiconductor and the like, i.e., determination of a GND point is important. A printhead heater, a driving circuit of a printing element and various logic circuits are formed on the element substrate by a semiconductor manufacturing process.

Figure 5:
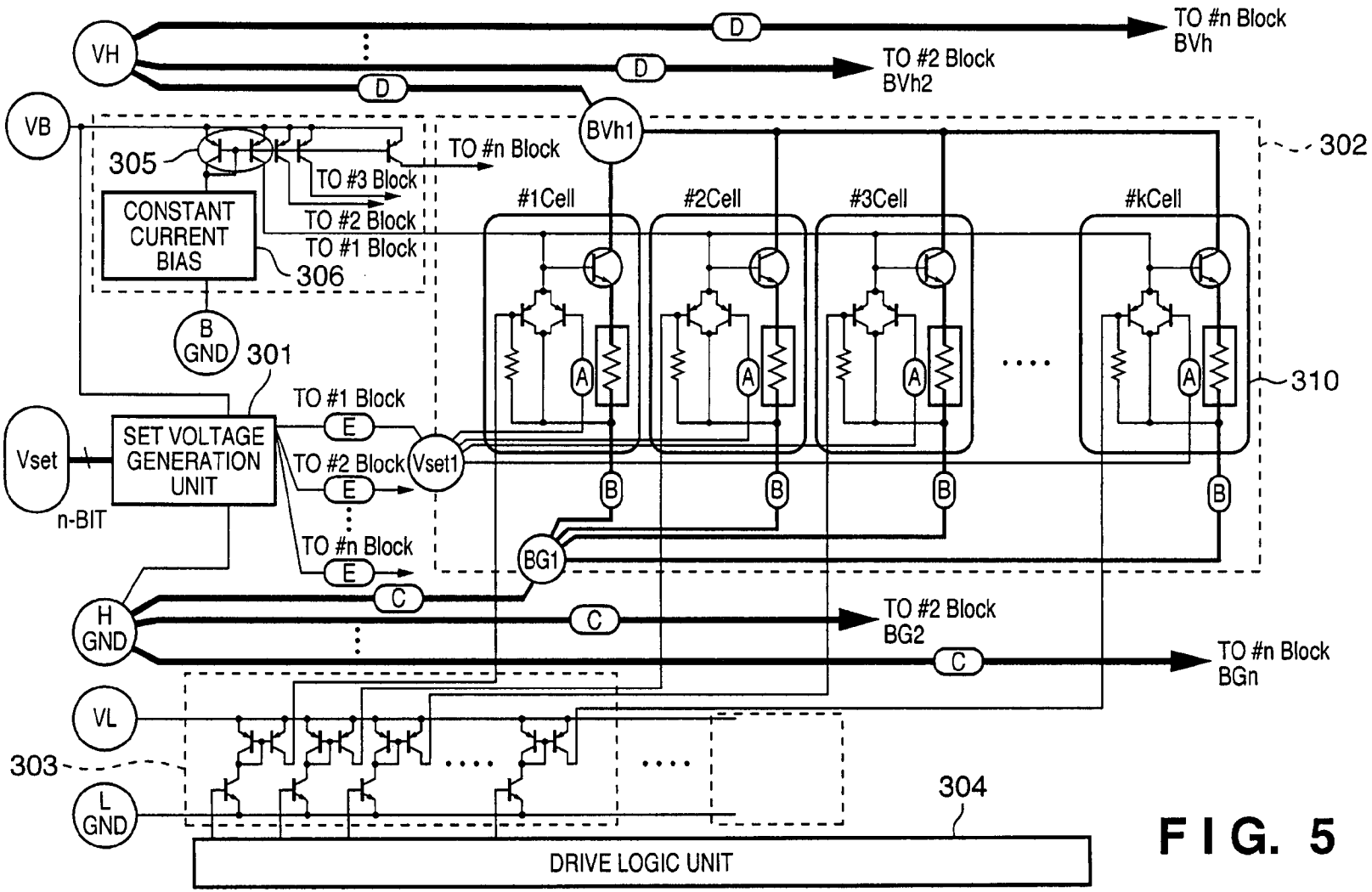
FIG. 5 is a block diagram representing various wirings and GND points within one block when the circuit configurations shown in FIGS. 3 and 4 are applied to the block of a printhead chip.

FIG. 5 is a block diagram showing various wirings and GND points within one block of a printhead chip when the circuits shown in FIGS. 3 and 4 are applied to the block.

Figure 6:
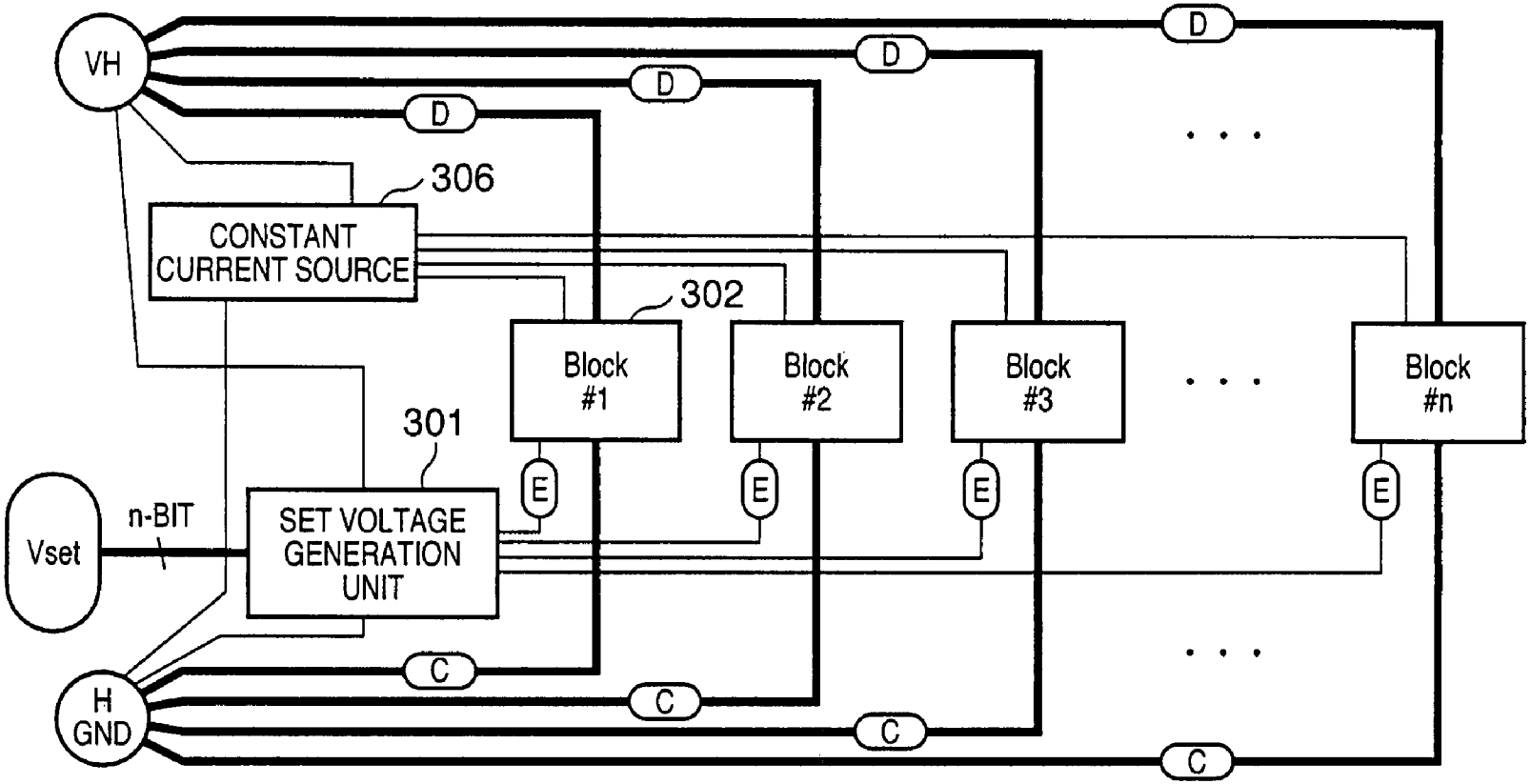
FIG. 6 is a block connection diagram representing various wirings between blocks within a printhead chip, and a GND point when the circuit configurations shown in FIGS. 3 and 4 are applied to a plurality (n) of the blocks of a printhead.
Figure 7:
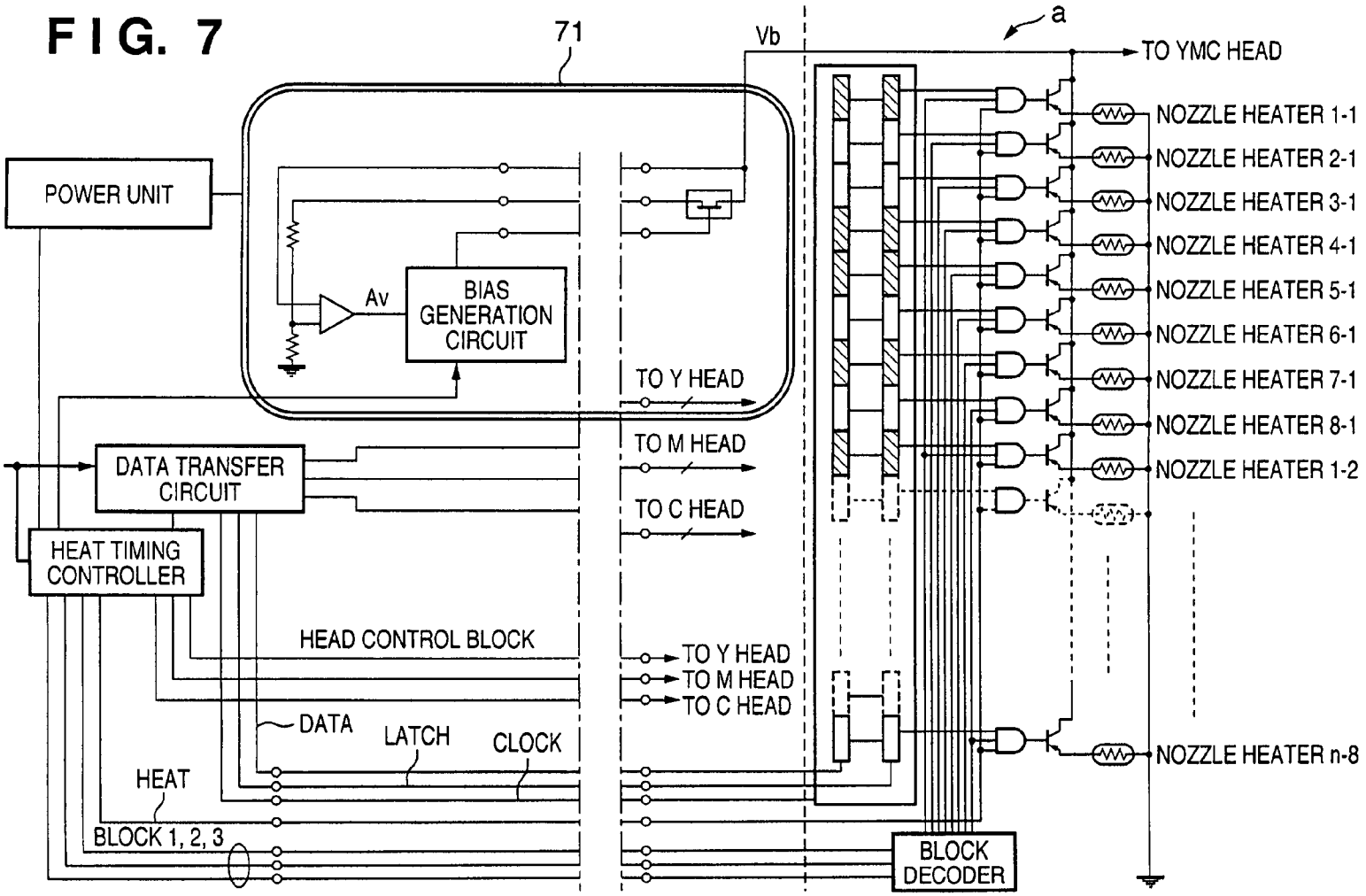
FIG. 7 is a view showing a circuit according to a first approach of conventional art.
Figure 8A:
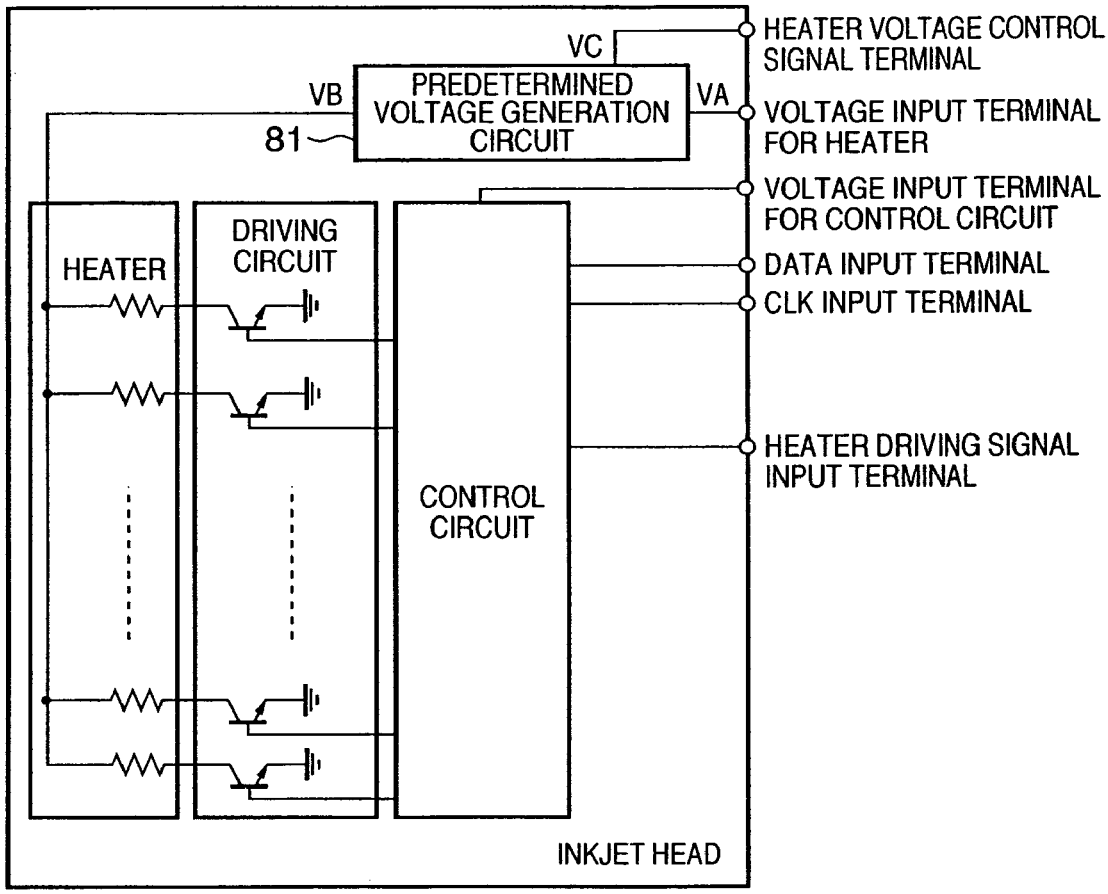
FIGS. 8A and 8B are views showing a circuit according to a second approach of conventional art.
Figure 8B:
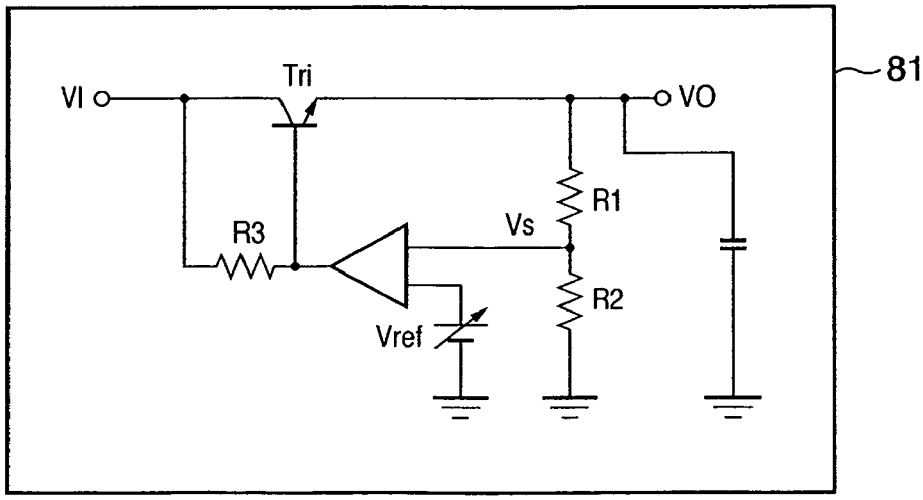
Figure 9:
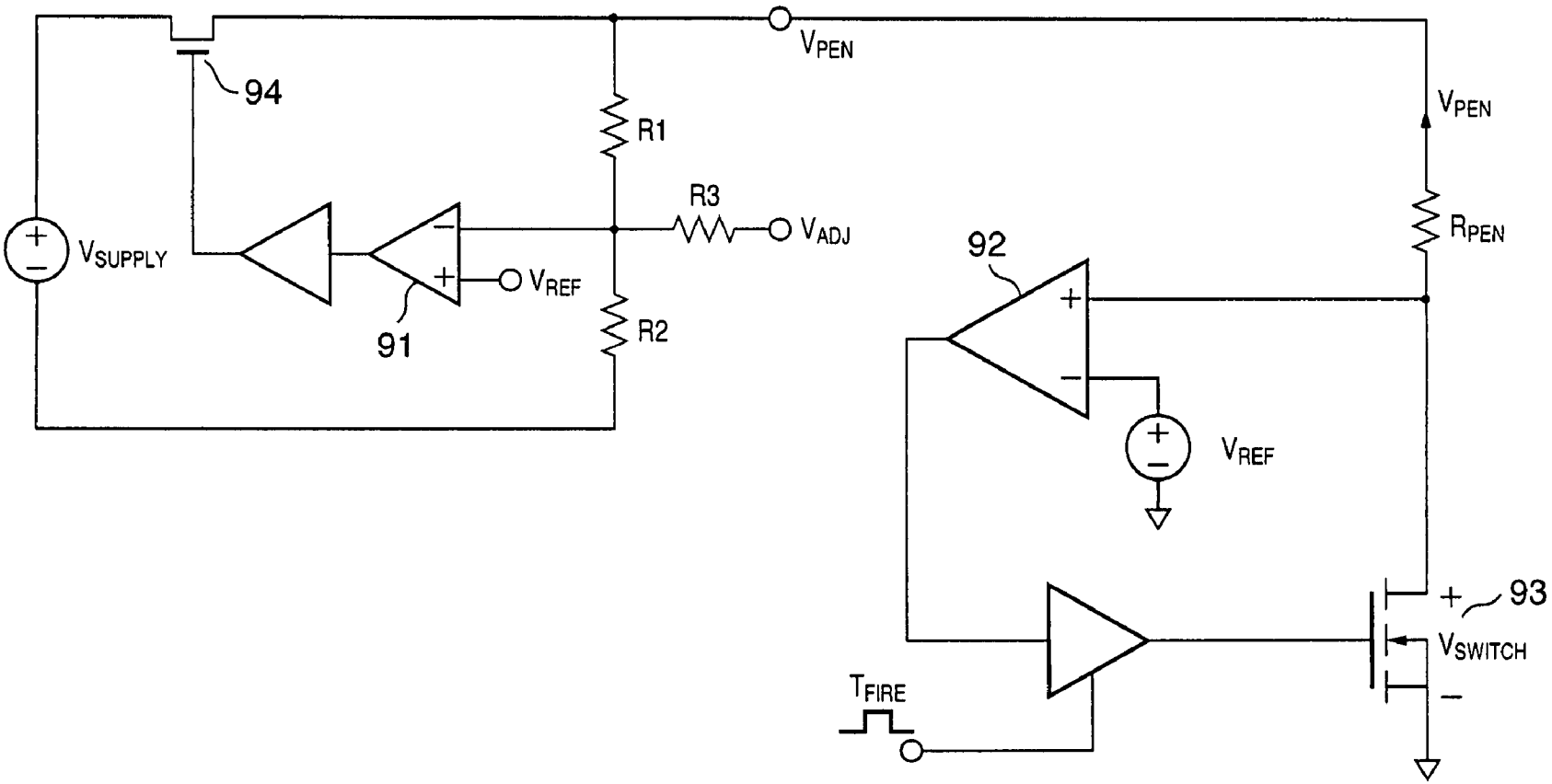
FIG. 9 is a view showing a circuit according to a third approach of conventional art.

FIG. 6 is a block connection diagram showing various wirings between blocks within a printhead chip and a GND point when the circuits shown in FIGS. 3 and 4 are applied to a plurality (n) of blocks of a printhead.

It is noted that FIGS. 5 and 6 are simplified drawings except portions required for explaining the present invention, and power supplying lines are mainly drawn. Thus, part of logic circuit wirings is omitted.

Wiring arrangement and GND point to be considered when the circuits shown in FIGS. 3 and 4 are applied to a printhead chip will be described below with reference to FIGS. 5 and 6.

Referring to FIG. 5, reference numeral 301 denotes a set voltage generation unit having the configuration shown in FIGS. 3 and 4, and 302 denotes one block obtained by dividing a chip into "n" blocks, each composed of "k" basic cells 10; herein, reference numeral 302 indicates a first block.

Reference numeral 303 denotes a group of circuits corresponding to one block ("k" circuits); each of the circuits is composed of transistors Q1, Q2 and Q5, and converts the level of driving pulse.

A drive logic unit 304 shown in the lower part of FIG. 5 is a logic circuit for generating actual driving data (driving signals of each heater) from image data, a block specifying signal and a driving pulse signal sent from the main body of printing apparatus (ASIC 603). Further, reference numeral 305 denotes a current mirror pair for supplying a constant current, 306 denotes a constant current source for supplying a bias current to a low-level prioritization circuit 2 for determining a voltage to be supplied to each printing element 4 within the block 302, and 310 denotes a basic cell corresponding to the basic cell 10 shown in FIG. 3.

In FIG. 6, the same reference numerals are applied to constituent components described in FIG. 5. Reference numeral 301 denotes a set voltage generation unit, and 302 denotes a block composed of "k" basic cells 310. Numeral following # indicates a block number.

In FIGS. 5 and 6, there are lines indicated by a reference symbol obtained by enclosing an alphabet letter (A to E) with an oval (hereinafter, simply referred to as line A to line E). This means that wiring portions indicated by the same alphabet letter are mutually an "equi-resistance wiring". More specifically, each line A is arranged so as to have an equal wiring resistance value measured from each of the "k" basic cells 310 within the block 302 to a terminal $V_{set}$ n (in FIG. 5, $V_{set}$ 1) being a supplying point provided one per block.

Each of the "n" blocks is connected to the set voltage generation unit 301 via line E having the same wiring resistance, and commonly connected at one point to the output of the set voltage generation unit 301.

Similarly, line B is arranged so that a line (pattern) extending from a GND point (corresponding to GND 2 in FIG. 3) of each of the "k" basic cells 310 to a terminal BGn (terminal BG1 in FIG. 5) being a common GND point provided for each block, has the same wiring resistance value.

Also, in FIGS. 5 and 6, the wirings between each of the "n" blocks and a GND supplying terminal of the printhead chip (HGND), between each of the "n" blocks and a power supplying terminal (VH), and between each of the "n" blocks and the set voltage generation unit are indicated by line C, line D and line E, respectively. In this manner, as for the wirings between each block and the GND supplying terminal (HGND) and between each block and the power supplying terminal (VH), wiring is arranged such that each line branching out from a common point to each block has the same wiring resistance value.

In FIGS. 5 and 6, lines without a reference symbol obtained by enclosing an alphabet letter with an oval, are hardly influenced by wiring resistance. Thus, they need not to be arranged so as to mutually have the same wiring resistance. Note here that wiring resistance value must have a required value and relative accuracy thereof needs not to be adjusted.

According to the configuration as described above, in the printing apparatus, the carriage having mounted thereon the printhead having a plurality of printing elements arrayed in a predetermined direction is moved in a direction crossing the arrayed direction to perform printing. In such a serial type printing apparatus, conventionally, a plurality of printing elements (heaters) of a printhead are divided into "n" blocks for a time-divisional driving.

Accordingly, the drive logic unit 304 receives image data and a driving pulse from the main body of printing apparatus and supplies a pulse signal to a printing element to be driven. At this time, a plurality of printing elements 4 within the same block are not driven at the same timing. However, a printing element within a basic cell having the same number in another block may be driven at the same timing. More specifically, the k-th basic cell of each block may be driven at the same timing depending on image data. Consequently, in the printhead having a configuration shown in FIGS. 5 and 6, the concurrently driven number varies from 0 to a maximum value n depending on image data.

The maximum value of voltage drop ($\Delta V_{drop}$) ascribable to this variance is expressed as:

$$\Delta V_{drop} = n \times I_{RH} \times (\text{common wiring resistance component})$$

where $I_{RH}$ denotes a heater current flowing through one printing element ($R_H$).

The value n varies momentarily depending on image data. Accordingly, this variation causes a voltage value applied to the printing element to vary, thus causing a variation in a discharged ink amount and exerting negative effects on printing images.

According to the present embodiment, as described with reference to FIGS. 5 and 6, lines A to E are arranged so as to have an equi-resistance wiring, whereby the variation in the concurrently driven number does not influence a GND voltage of the set voltage generation unit, and thus all the basic cells within one printhead chip are driven by a voltage (Vset) set by the set voltage generation unit. Also, the wiring resistance extending to the concurrently driven printing elements goes back to the common GND supplying terminal (HGND) being the original point via line B and line C. Consequently, there is no difference of voltage drop between concurrently driven nozzle heater resistors, thus causing no variation between the printing elements.

Also, as for the voltage drop ascribable to the common wiring extending to the GND supplying terminal (HGND), the HGND voltage being the reference of the set voltage generation unit varies by a voltage drop ($\Delta V_{drop}$) expressed as the above described formula. However, even when the HGND voltage varies, the GND voltage varies only relatively, and the printing element is still driven by a voltage value obtained by subtracting from the set voltage ($V_{set}$) generated by the set voltage generation unit, a voltage drop generated by a current ($I_{RH}$) flowing through one heater resistor via fixed wiring resistances (the wiring resistance of line B and line C). This does not affect the concurrently driven number n.

Also, as already described, the voltage for driving the printing element 4 is determined by the emitter voltage (in this case, set voltage ($V_{set}$)) of the NPN transistor 3. Thus, the voltage in the collector side of the NPN transistor 3 within the basic cell 10 may vary within a range of voltage at which the constant current source 5 can stably operate.

More specifically, the influence of wiring in the power supplying side is small even when the wiring resistances are not equal to each other. Accordingly, as shown in FIG. 5, the wirings within the block are not arranged as equi-resistance wirings. Meanwhile, the wirings between blocks within a printhead chip are comparatively long and thus arranged as equi-resistance wirings.

Thus, according to the embodiment described above, since a voltage drop ascribable to wiring is also taken into consideration, even when the concurrently driven number varies at order of microsecond, the printing element can be driven by the substantially stable set voltage ($V_{set}$). Consequently, regardless of the concurrent driven number, the ink discharge performance of each printing element is made constant, thus improving printed image quality. In addition, the time taken to switch the set voltage ($V_{set}$) is approximately equal to the operating time of the DAC, thus making it possible to improve the driving frequency to improve the printing speed.

Second Embodiment

A second embodiment of a printhead according to the present invention will be described below. In the following description, a description of parts corresponding to the first embodiment is omitted, and characteristic parts of the second embodiment are mainly described.

According to the first embodiment, a set voltage generation unit is provided, whereby the printing element 4 is driven by a stable set voltage ($V_{set}$) regardless of the concurrently driven number varying according to image data, and the discharge performance is thus stabilized.

In contrast, according to the second embodiment, the voltage applied to the printing element by the set voltage generation unit is actively controlled so as to vary a discharged ink amount from the nozzle, i.e., the size of dot formed with ink.

More specifically, according to the second embodiment, when a large size of ink droplet is discharged, the set voltage ($V_{set}$) is set high, and when a small size of ink droplet is discharged, the set voltage ($V_{set}$) is set low.

When the low-level prioritization circuit 2 and the set voltage generation unit 1 described above allow the set voltage to vary at order of microsecond, this control is implemented.

According to the second embodiment, it is possible to accurately control the size (amount) of ink droplet discharged from the same nozzle. A pixel has hitherto been formed by discharging a small size of ink droplet several times. However, according to the second embodiment, a pixel can be formed by discharging a large size of ink droplet at a smaller number of operations. Accordingly, with respect to a high-resolution image formation conventionally achieved by discharging a small size of ink droplet, also, printing speed can be improved.

Other Embodiment

In the embodiment described above, a circuit using bipolar transistors is described. However, the present invention is not limited to this. For example, the PNP transistor may be replaced with a P channel MOS transistor, and the NPN transistor may be replaced with an N channel MOS transistor. With such configuration, also, an effect similar to that of the above-described embodiment can be achieved.

Also, combining the advantages of the respective transistor characteristics, a driving circuit manufactured by Bi-CMOS process may be used.

Further, even when a GND reference is replaced with a power reference, the logic of driving pulse input is operated according to negative one, and the NPN transistor and PNP transistor are replaced with each other, then an effect similar to that of the above described embodiment can be expected.

Also, not only the printing apparatus for performing printing by use of the printhead described in the aforementioned embodiment, but also the printhead itself described in the aforementioned embodiment, and the printhead element substrate (chip) constituting the printhead, or a printing carriage with the printhead and ink tank integrated are included within the scope of the present invention.

Also, in the aforementioned embodiment, the inkjet printhead using a heater as the printing element is described. However, such problem ascribable to a variation in the number of concurrently driven printing elements is common to a printhead according to another printing method. Accordingly, the present invention is also applicable to a printing apparatus for performing printing by use of a printhead having a plurality of printing elements according to another printing method.

In addition, as embodiments of the printing apparatus according to the present invention, there may be: a printing apparatus provided integrally or separately as the image output terminal of an information processing apparatus such as a computer; a copier combining a printing apparatus, a reader and the like; a facsimile apparatus having a transmitting/receiving function; and a multi-functional machine combining these functions.

As many apparently widely different embodiments of the present invention can be made without departing from the spirit and scope thereof, it is to be understood that the invention is not limited to the specific embodiments thereof except as defined in the appended claims.

This application claims the benefit of Japanese Application No. 2005-107750, filed Apr. 4, 2005 which is hereby incorporated by reference herein in its entirety.

What is claimed is:

1. A printhead with a plurality of printing elements, comprising:

a driving circuit for applying a predetermined voltage to each printing element according to a pulse signal, for driving a printing element, inputted to the printhead, wherein the driving circuit includes set voltage generation means for generating the predetermined voltage according to a setting signal inputted to the printhead, and the driving circuit includes a low-level prioritization circuit for receiving the predetermined voltage and a first voltage generated when a switching element of which a conduction state is controlled by the pulse signal is turned on, and for outputting a lower one of the predetermined voltage and the first voltage.

2. A printhead with a plurality of printing elements, comprising:

a driving circuit for applying a predetermined voltage to each printing element according to a pulse signal, for driving a printing element, inputted to the printhead, wherein the driving circuit includes set voltage generation means for generating the predetermined voltage according to a setting signal inputted to the printhead, wherein the driving circuit includes a low-level prioritization circuit for receiving the predetermined voltage and a first voltage generated when a switching element of which a conduction state is controlled by the pulse signal is turned on, and for outputting a lower one of the predetermined voltage and the first voltage, and wherein the first voltage is higher that the predetermined voltage.

3. A printhead with a plurality of printing elements, comprising:

a driving circuit for applying a predetermined voltage to each printing element according to a pulse signal, for driving a printing element, inputted to the printhead, wherein the driving circuit includes set voltage generation means for generating the predetermined voltage according to a setting signal inputted to the printhead, wherein the setting signal is a digital signal of a plurality of bits representing information on a number of concurrently driven printing elements, and wherein the set voltage generation means includes a D/A converter for converting the digital signal to an analog signal.

4. The printhead according to claim 1, wherein the plurality of printing elements, the driving circuit and the set voltage generation means are formed on a common element substrate by a semiconductor manufacturing process.

5. The printhead according to claim 4, wherein wiring is made in the element substrate so that a reference voltage of the set voltage generation means is substantially equal to a reference voltage of the plurality of printing elements.

6. The printhead according to claim 4, wherein the plurality of printing elements are divided into a plurality of blocks, each having a predetermined number of printing elements, and wiring is made in the element substrate such that a reference voltage of each printing element is branched out from a common point, and resistances of wirings extending from the common point to each printing element within each block are equal to each other.

7. The printhead according to claim 6, wherein wiring is made in the element substrate such that the wiring resistances of power wirings extending to each block are equal to each other.

8. The printhead according to claim 7, wherein the predetermined voltage is supplied from the set voltage generation means to each block, and the reference voltage of the set voltage generation means is branched from a reference point of the power wiring, and applied.

9. The printhead according to claim 1, wherein each printing element includes an electrothermal transducer, and discharges ink by use of thermal energy generated by the electrothermal transducer to perform printing.

10. A printhead carriage including a printhead according to claim 9 and an ink tank containing ink to be supplied to the printhead.

* * * * *